United States Patent [19]

Le Page et al.

[11] Patent Number: 4,715,946

[45] Date of Patent: Dec. 29, 1987

[54] PROCESS FOR DEASPHALTING A HYDROCARBON CHARGE CONTAINING ASPHALTENES

[75] Inventors: Jean-Francois Le Page, Rueil Malmaison; Alain Billon, Orlienas; Frédéric Morel, Sainte Foy Les Lyon; Pierre Renard, Saint Nom la Breteche; Jean-Michel Biedermann, Montivilliers; Michel Laborde, Sainte Foy les Lyon; Jacques Bousquet, Irigny, all of France

[73] Assignee: Institut Francais du Petrole, Rueil-Malmaison, France

[21] Appl. No.: 848,083

[22] Filed: Apr. 4, 1986

[30] Foreign Application Priority Data

Apr. 5, 1985 [FR] France ..... 85 05350

[51] Int. Cl.[4] ..... C10C 3/00

[52] U.S. Cl. ..... 208/45; 208/309

[58] Field of Search ..... 208/45, 309, 34

[56] References Cited

U.S. PATENT DOCUMENTS

| | | | |
|---|---|---|---|
| 2,729,589 | 1/1956 | Waghorne et al. | 208/309 |
| 3,202,605 | 8/1965 | Redcay | 298/45 |
| 3,278,415 | 10/1966 | Doberenz et al. | 208/309 |
| 3,311,551 | 3/1967 | Van Pool | 208/45 |
| 4,094,770 | 6/1978 | Bose | 208/177 |
| 4,101,415 | 7/1978 | Crowley | 208/309 |
| 4,239,616 | 12/1980 | Gearhart | 208/45 |
| 4,554,055 | 11/1985 | Rooney | 208/45 |
| 4,571,781 | 2/1986 | Krasuk et al. | 208/309 |

FOREIGN PATENT DOCUMENTS

| | | | |
|---|---|---|---|
| 735833 | 8/1955 | United Kingdom | 208/45 |

*Primary Examiner*—Andrew H. Metz
*Assistant Examiner*—Anthony McFarlane
*Attorney, Agent, or Firm*—Millen & White

[57] ABSTRACT

Process for deasphalting a hydrocarbon charge by means of a deasphalting solvent.

The charge (1) is introduced, at 100°-200° C., in admixture with a deasphalting solvent (3and 4), into a settler (7). The deasphalted oil (24) is separated from the solvent (23). Asphalt (9) is washed in a column and then separated from the washing liquid (21).

12 Claims, 3 Drawing Figures

PROCESS FOR DEASPHALTING A HYDROCARBON CHARGE CONTAINING ASPHALTENES

BACKGROUND OF THE INVENTION

The process forming the object of the present invention is applicable to the treatment of conventional crude oil residues, either straight-run or vacuum residues, as well as to the treatment of heavy or extra-heavy topped oils such as obtained, for example, from the fields of FAJA PETROLIFERA in Venezuela or from the fields of ATHABASCA in Canada. By extension, the claimed process will also be advantageously used for the treatment of straight-run or vacuum residues issued from another thermal or catalytic previous treatment such as visbreaking, hydrovisbreaking, thermal treatment in the presence of a hydrogen donor solvent, various catalytic hydrotreatments with more or less extensive conversion of the treated charge.

These various charges are characterized by the fact that they contain resins and asphaltenes which are organic products of high molecular weight containing a large proportion of S, N and O heteroatoms, with which metals, particularly nickel and vanadium, are complexed.

The disadvantages of these asphaltenes and resins in refining operations are well known, as well for catalytic as for thermal processes.

These disadvantages are related to their high content of heteroatoms but mainly to their low H/C ratio and to the presence of nickel and vanadium as complexed metals.

For catalytic cracking, in the presence of zeolite catalysts, for example, the presence in the charge of compounds of said type produces an increase of the coke deposit on the catalyst with the liability of rupture in the unit thermal balance and of increase of the regeneration temperature up to such values that zeolites quickly loss their crystallinity; the presence of nickel results in the deposition of said metal on the catalyst with, as a consequence, an increased production of uncondensable gases and of hydrogen and an increase of the coke deposit. Now, vanadium, when deposited on the catalyst, may also form with the zeolites exchanged with rare earths, constituting the active phase of the usual catalysts for this type of reaction, a mixed compound producing a loss of crystallinity and, accordingly, a loss of activity.

In hydrotreatment operations, such catalyst poisoning is well known. The progressive deposition of nickel and vanadyl sulfides on such active agents as sulfides of metals from group VI A (molybdenum or tungsten) promoted by sulfides of metals from group VIII (nickel and cobalt), results in a progressive decrease of the desulfurizing, denitrogenating and hydrogenating activities of these catalysts.

In hydrocracking, the asphaltenes content, determined by precipitation with heptane according to the French Standard AFNOR NFT 60115, must be almost undetectable in order to avoid the quick poisoning of the catalyst acid sites with subsequent coke production.

In visbreaking, the severity of the operating conditions also depends on the content of said asphaltene products and on their intrinsic stability. For a given charge, a too high severity, expressed in terms of excessive temperature and (or) maturation time, results in the coagulation of the partially cracked asphaltene molecules with production of colloidal micelles which tend to settle during storage and to plug the filters of the use apparatus.

All these disadvantages have induced refiners to make searches in view of selectively separating the asphaltene and resin compounds from the oil fraction containing them. This separation, called deasphalting by solvent, consists of breaking the existing equilibrium between asphaltenes and the maltene surrounding medium by addition of a solvent which decreases the viscosity and, overall, the interfacial tension of the oil medium. The recommended solvents are generally light paraffins or (and) olefins of 3, 4, 5, 6 and (or) 7 carbon atoms. In fact, the light paraffin acts, with respect to asphaltenes and optionally with respect to resins, as an anti-solvent. Asphaltenes and resins are rejected outside from the oil medium as a separate phase, and this to a greater extent as the density and the interfacial tension of the solvent plus oil medium are lower. Consequently, the "asphalt phase" yield and the quality of the deasphalted oil, for a given charge, relate to the following parameters and variables: nature of solvent, proportion of solvent, temperature and pressure, but they also depend to a very large extent on the characteristics of the selected technology.

The process according to the present invention thus relates to deasphalting of hydrocarbon solvents comprising paraffinic or olefinic hydrocarbons having 3 to 7 carbon atoms. However, the hydrocarbon solvent is used in such a manner as to obtain high yields of an oil of very high grade with a minimum solvent content and to make possible its extrapolation to industrial units having annual treatment capacities in single line ranging from about 2 to 4 millions of tons.

OBJECTS OF THE INVENTION

A first object of the present invention is to perform the deasphalting of an asphaltene-containing hydrocarbon charge, particularly a residue or a heavy oil, by means of a solvent having from 3 to 7 carbon atoms, so as to obtain an oil containing less than 0.05% of asphaltenes, precipitated by heptane, according to Standard AFNOR NFT 60115.

A second object of the invention is to selectively achieve the operation, i.e. to obtain a deaphalted oil of high grade with a very good yield, with the use of a minimum amount of solvent, i.e. solvent/oil volume ratios which may be as low as 3/1 to 4/1.

A third object of the invention consists in proceeding by separation of the elementary physico-chemical operations composing the overall deasphalting operation: mixing-precipitation, settling of the asphalt phase, washing-peptization of the asphalt phase.

The process according to the invention makes it possible to treat very large annual capacities of residues or heavy oils in a single settler while conforming with the quality and yield criteria constituting the first and the second object of the invention.

PRIOR ART

The prior art covers a very wide range of deasphalting techniques whose peculiarity comes from the type of solvent used, the range of recommended operating conditions, the use of special additives, some technical characteristics of the process or the operation in several successive steps.

Thus, U.S. Pat. No. 1,948,296 claims the use as solvent of propane, n-butane, isobutane, light oil fractions, naphtha, alcohols or mixtures thereof.

U.S. Pat. No. 2,081,473 states the general concept of the deasphalting operation, recommends accordingly the whole series of the above-mentioned solvents, from methane to naphtha, including propane, butane and light gasoline, but its does not specify either the recommended range of solvent/oil ratios or, with greater reason, the "de facto" dissociation of the operation into its elementary physico-chemical steps with application in each step of a range of optimum operating conditions.

U.S. Pat. Nos. 2,587,643 and 2,882,219 claim the use of modifying agents or additives, either to the solvent, i.e. organic carbonates in U.S. Pat. No. 2,587,643, or to the charge, i.e. aromatics in U.S. Pat. No. 2,882,219.

U.S. Pat. Nos. 3,278,415 and 3,331,394 also recommend the use of additives to the solvent, i.e. phenol and glycol respectively.

Now, U.S. Pat. Nos. 2,002,004, 2,101,308 and 3,074,882 recommend to proceed to the deasphalting operation in two or more successive steps, but the considered step sequences are different in their conception from those according to the present invention. Thus U.S. Pat. No. 2,002,004 concerns a two-stage deasphalting process with intermediary distillation of the hydrocarbon phase of high solvent content obtained from the first extraction zone. The bottom effluent of the distillation column is subjected to a second deasphalting step, whereby resins can be separated.

U.S. Pat. No. 2,101,308 recommends a first deasphalting step with light gasoline as solvent; the oil-light gasoline mixture obtained from said first step is treated with $SO_2$ in view of a subsequent removal of resins and aromatics.

According to U.S. Pat. No. 3,074,882, a first precipitation is performed with butane. Butane is separated from the oil-butane mixture and the residual oil is treated with propane in two successive stages giving resins, on the one hand, and deasphalted and deresinized oil, on the other hand.

The use of separate solvents in two steps of the process is also disclosed in British Pat. No. 735 333.

Now, U.S. Pat. No. 3,830,732 also recommends a two-step deasphalting comprising a first step of precipitating asphaltenes and resins with a first solvent in a solvent/oil volume ratio lower than 4/1, then a second step of repeptizing the asphalt phase obtained in the first step by means of a solvent having at least one carbon atom more than the solvent recommended in the first step. By peptization of the asphalt phase, resins can be dissolved again in the second solvent. After recovery of both solvents which are recycled to their respective stages, a deasphalted and deresinized oil is obtained, as well as a resin phase and an asphalt phase. A particular claim of this patent recommends to operate the first step at a higher temperature than the second step.

Although, in its conception, the present invention has some similarities with that of U.S. Pat. No. 3,830,732, it clearly differs therefrom in three essential points.

The repeptization of the asphalt phase is performed substantially with the same solvent as the precipitation of said asphalt phase.

The mixture of the solvent with the oil, as well as the precipitation, are achieved before settling and not in the settler itself.

By the use of a single solvent it is possible to have recourse to a novel technique in order to optimize the sequence of the steps consisting of mixture-precipitation, settling of the asphalt and washing thereof. In accordance with the treatment capacity, various embodiments of the technique according to the present invention can be used, all of these embodiments depending on the same basic principle.

The recommended recyclings in the various embodiments of the process provide for a maximum yield of deasphalted oil containing less than 0.05% of asphaltenes (Standard AFNOR NFT 60115).

SUMMARY OF THE INVENTION

Preferred characteristics for carrying out the process of the invention are as follows:

The washing solvent of the asphaltene phase is the same as that used for the precipitation step.

The mixture of the charge to be deasphalted with the deasphalting solvent is performed before the exchanger which increases the mixture temperature to the required value, in order to achieve a good precipitation and a good settling.

The charge-solvent mixture passes through the tubes of the exchanger and not on the shell side.

The residence time of the charge-solvent mixture in the mixing-precipitation zone ranges from 5 sec. to 5 min., preferably from 20 to 120 seconds.

The residence time of the mixture in the settling zone ranges from 4 to 20 minutes.

The residence time of the oil-solvent mixture in the washing zone is also from 4 to 20 minutes.

The upflow velocity of the oil-solvent mixture, as well in the settling zone as in the washing zone, will be usefully lower than 1 cm/s and preferably lower than 0.5 cm/s.

The temperature in the washing zone will be from 5° to 50° C. lower than the temperature in the settling zone.

The oil-solvent mixture issued from the washing zone will be recycled to the settler and, more advantageously, before the exchanger connected to the input of the settling zone.

The solvent/asphalt phase ratio recommended in the washing zone will range from 0.5 to 8, preferably from 1 to 5.

According to one of its embodiments, the process may comprise two stages, each stage including the three elementary steps of precipitation, settling and washing. In this precise embodiment, the recommended temperature in each step of the first stage is preferably, as an average, from 10° to 40° C. lower than the temperature in each corresponding step of the second stage. In the process according to the invention, the hydrocarbon solvents may have from 3 to 7 carbon atoms and may be of the paraffinic, olefinic or cyclanic type. They can be used separately or admixed together in various proportions or with additives, for example phenol, glycol, C1–C6 alcohols.

The process according to the present invention is advantageously adapted to the use of paraffinic and (or) olefinic solvents having from 4 to 6 carbon atoms.

A more complete description of the drawings is given in the detailed description of the invention.

DETAILED DESCRIPTION OF THE PROCESS

Figure 1:
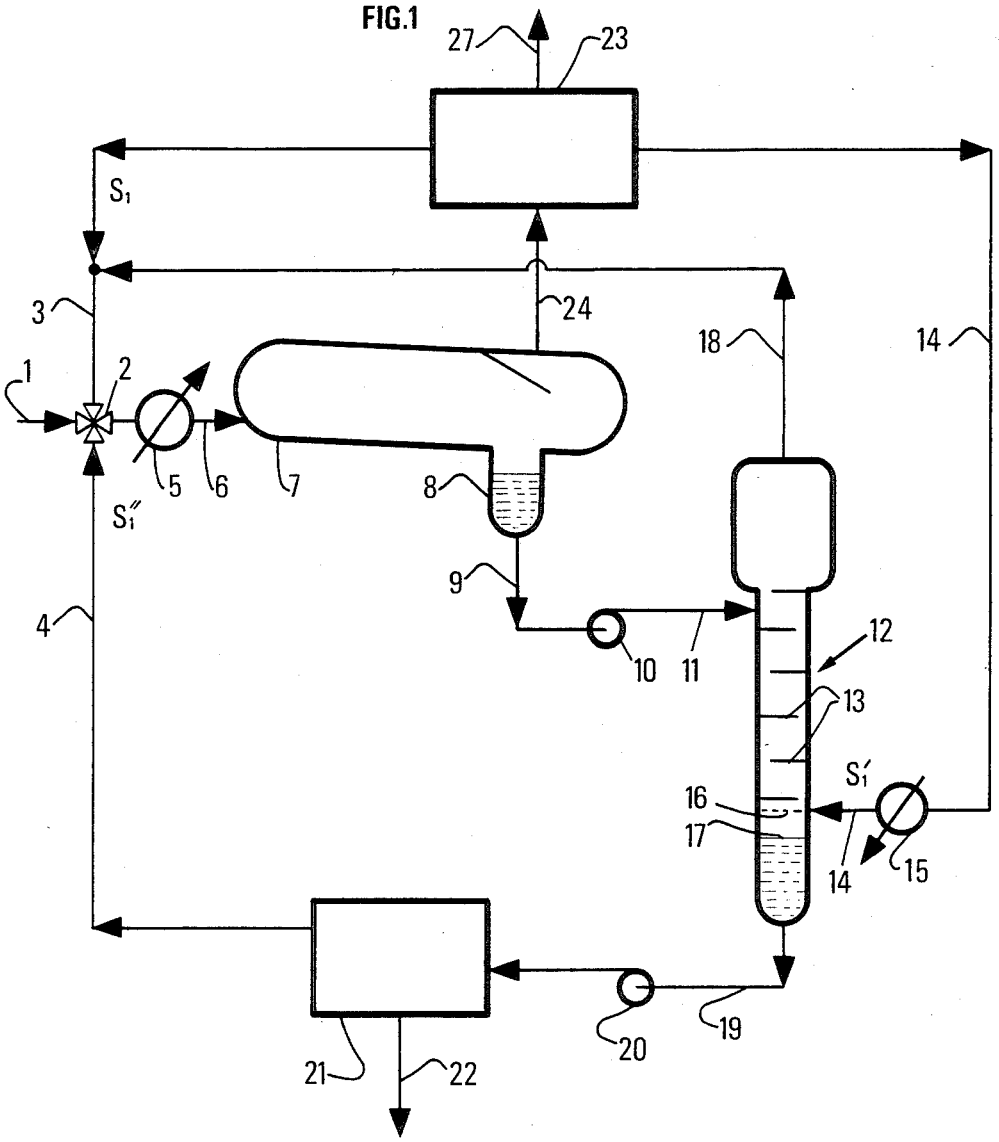
FIG. 1 is a flow sheet showing the characteristics of the process of the invention. The charge is introduced through line (1) supplied to valve (2). Solvent S1 and S"1 recovered from solvent (23) are introduced to mixing valve (2) through lines (3) and (4). The charge/solvent mixture passes through exchanger (5) where precipitation occurs and is subsequently introduced through line (6) into settling drum (7) wherein the asphalt phase is settled. The asphalt phase is recovered from bottom extension (8) by means of pump (10) through lines (9) and (11) through to column or tower (12) where the asphalt phase is washed and a portion of the resin is selectively repeptized by solvent S'1, recycled from fractionation unit (23) through line (14). The washing solvent is temperature adjusted in exchanger (15). The asphalt phase is withdrawn from the washing column bottom by pump (20) through line (19), fed to vaporization tower (21) wherein the asphalt is withdrawn through line (22).

FIG. 1 is a flow-sheet showing the essential characteristics of the process of the invention. The charge to be treated is introduced through line (1) and supplied to the mixing valve (2) wherein is introduced solvent S1 and S"1, as recovered from solvent (23) respectively contained in the solvent-oil mixture and in the solvent-asphalt phase mixture (lines 3 and 4). The charge-solvent mixture passes through exchanger (5) where it is brought to the temperature required for the considered deasphalting operation; this temperature will range from 100° to 220° C., depending on the considered solvent (for example isobutane, butane, isopentane, pentane, light gasoline), on the type of the treated charge (topped crude oil, straight-run residue, vacuum residue), on the origin of the considered crude oil and on the solvent/oil ratio. For example, for treating a vacuum residue of the SAFANYA type, with a solvent/oil ratio from 3/1 to 5/1, the output temperature of the exchanger will range from 190° to 170° C. and the pressure from 4 to 5M Pascals, as far it is desired to obtain a deasphalted oil containing less than 0.05% of asphalts, according to Standard AFNOR NFT 60115. It is important to specifiy that, according to one of the preferred characteristics of the process, the charge-solvent mixture passes through the tubes of the exchanger and not on the shell side; in addition, it is recommended to proceed in this exchanger by gravitational flow, the charge-solvent mixture thus flowing downwardly through the tubes of the exchanger.

At the exchanger output, the mixture, brought to the required temperature, is introduced, through line (6), into extractor (7) where settling occurs. The precipitation of the asphalt phase begins almost instantaneously at the level of the mixing valve and continues in exchanger (5) during the temperature increase. In order to obtain a good precipitation and a good coagulation of the asphalt micelles before introduction into the settling drum, the residence time of the mixture between the mixing valve and the input of the settler will preferably range from 5 seconds to 5 minutes and more preferably from 20 seconds to 120 seconds. The turbulence in duct (6) is also usefully controlled in order to avoid the breaking into too small particles of the micelles of the asphalt phase suspended in the oil-solvent medium; in practice it is recommended that, at the output of the exchanger, the REYNOLDS number of the mixture be in the range from $2.10^4$ to $10^6$ and preferably from $5.10^4$ to $5.10^5$. Within this range of values, it is further observed that the micelles begin to agglomerate, thus making easier and quicker a subsequent settling in the settling drum.

In the settling drum (7) the micelles of the asphalt phase are agglomerated and settled. The volume and geometry of the settler are so calculated that the residence time of the solvent-oil mixture be from 4 to 20 minutes and preferably from 8 to 15 minutes and that the velocity of the solvent-oil upflow be always lower than 1 cm per second. The settling drum preferably operates isothermally, i.e. at a temperature substantially equal to the input temperature of the mixture, with the exception of the heat losses. The asphalt phase is recovered in a bottom extension (8) where level regulation means controls its withdrawal by pump (10), feeding it, through lines (9 and 11) to column or tower (12) where the asphalt phase is washed and a portion of the resins is selectivity repeptized by the solvent S'1, recycled from the fractionation unit (23) through line (14). Exchanger (15) provides for the adjustment in temperature of the washing solvent to the optimum temperature for the considered operation.

The pressure applied in the washing tower is preferably very close to the pressure at the settler input. The temperature of solvent S'1 at the input of the tower will preferably be from 5° to 50° C. lower than the temperature of the asphalt phase introduced through line (11) at the top of the washing zone. The temperature gradient between the inputs of lines (11) and (14) makes it possible to adjust, for a given flow of solvent S'1 and an asphalt phase of given type, the rate of repeptization of the resins, i.e. it provides for the adjustment of the asphalt yield and of the asphalt softening point. The solvent flow rate also has an effect on the asphalt yield and on its softening point. According to the process of the invention, this flow rate is so adjusted that the solvent to asphalt phase volume ratio be in the range from 0.5 to 8 and preferably from 1 to 5.

The column is advantageously operated in such a manner that the settling level of the asphalt phase (17) be maintained below line (14) for injection of solvent S'1 and, more precisely, below the distribution device (16) of said solvent in the continuous solvent-oil medium, although an adjustment to a higher level nevertheless gives good performances. The column is preferably equipped with baffle plates (13) providing for a better contact between the micelles of the asphalt phase and the solvent upflow. These baffles are preferably so calculated that the upflow velocity of the solvent or, more precisely, of the solvent phase with additional washed oil and peptized resins, remains lower than 36 m/hour. Preferably the top of the column is always free of baffles reducing the upflow and may be designed of a slightly larger diameter so as to avoid any driving away of asphalt phase colloidal particles of a diameter smaller than one micron. In an embodiment of the process, the product discharged from the top of the column is recycled, in liquid phase, through line (18), to solvent S1, slightly before the mixing valve (2).

In others words, the cross-sectional area of the upper portion of the column is greater than that portion of the column below the point of introduction of the heavy asphalt phase, as evident from the depiction of column (12) in FIG. (1).

The asphalt phase, swelled with a substantially pure solvent, is withdrawn from the washing column bottom by means of pump (20), through line (19), and fed to the vaporization tower (21), wherefrom asphalt is withdrawn through line (22), after separation from the solvent which is recycled through line (4), either to the settler input or before the settler, preferably to the mixing valve. The recovery of the solvent associated with the deasphalted oil is diagrammatically shown by block (23) and may for example be achieved in the process according to the invention by vaporization of the solvent in a cascade of evaporators, either of the conventional exchanger type or preferably of the falling-film type or by separation of the solvent phase from the oil-phase in a settler operating under super-critical conditions or by ultra-filtration of the solvent over suitable inorganic membranes. The deasphalted oil flows out through line (27).

Figure 2:
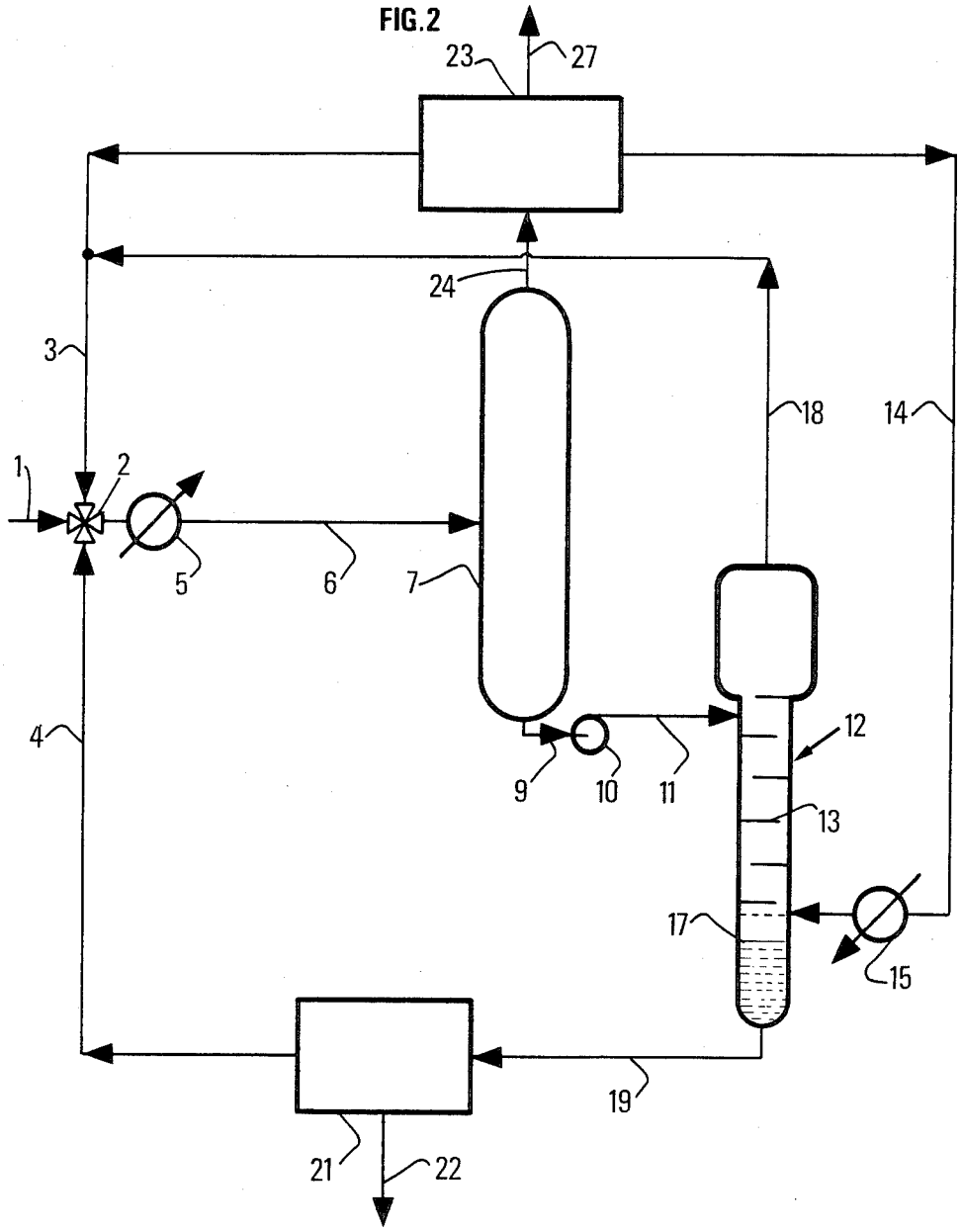

In the above-described embodiment, the settler, of elongate shape, was provided with a bottom extension and was preferably inclined by 5° to 10° with respect to the horizontal plane, in order to allow a free flow of the asphalt phase towards the underlying bottom extension. In order to comply with the invention, the settler must not necessarily be of elongate shape in a substantially horizontal position but it may also be vertical as shown in FIG. 2, inasmuch as said geometry complies with the requirements of upflow velocity and of settling time as above stated. This geometry, which requires at least a large surface available on the ground, will hence be recommended for the treatment of annual capacities lower than 2 millions of tons: Although the settler is, for process operating conditions, placed vertically, the steps arrangement and the recommended operating conditions are strictly those defined as the object of the present invention.

Figure 3:
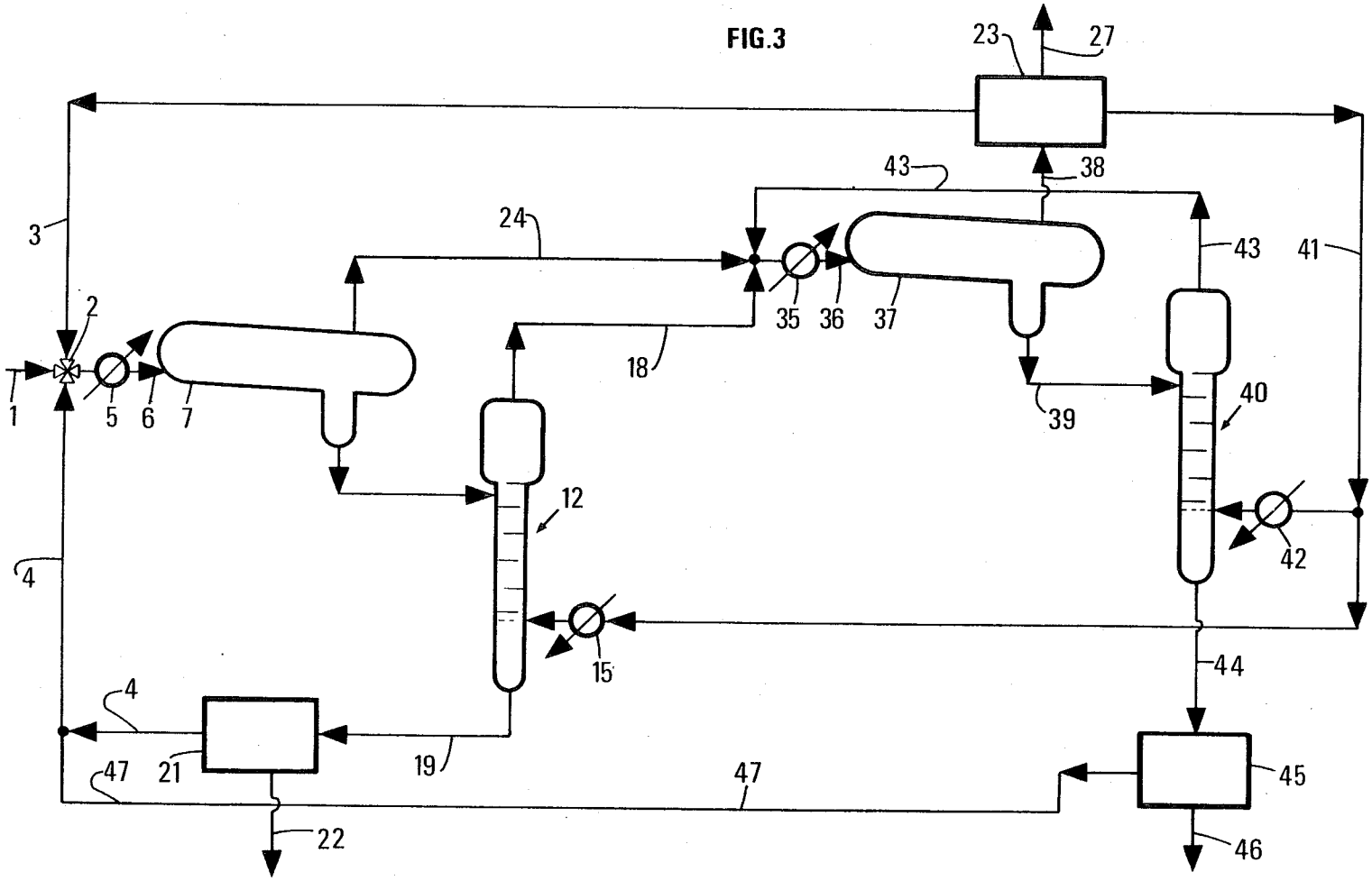

In a last embodiment of the process the operation is conducted in two stages with precipitation of a hard asphalt phase in a first stage and precipitation of a resin phase in a second stage. The mere idea of separately producing an asphalt phase and a resin phase is known and industrially used since a long time and forms no part of the present invention. The object of the invention relates to the fact that each stage, as diagrammatically shown in FIG. 3, comprises a succession of three elementary steps: mixture-precipitation, settling, washing-repeptization, in a quite similar way as described for the preceding embodiments where asphalts and resins were precipitated in a single phase. According to said embodiment, the precipitation and the settling in the first stage are achieved at a temperature from 20° to 60° C. lower than that applied when proceeding to a single step precipitation, i.e. at the minimum temperature for maintaining the asphalt phase liquid and sufficiently fluid at the output of the settler for being handled without difficulty. The asphalt phase washing step in said embodiment is performed at a temperature equal or slightly higher than that of the settler. The solvent-oil-resins mixture obtained after washing, through line (18), is admixed with the solvent-oil-resins mixture issued from the first settler (24).

In the second stage, the solvent-oil-resins mixture is heated (35) at a temperature from 30° to 70° C. above that applied to the first settler. As in the first stage, the solvent-oil-resins mixture preferably passes through the tubes of the exchanger and not on the shell side; moreover, the flow of the solvent-oil-resins mixture will be a gravitational flow; the extract is separated through line (38) for fractionation in separator (23). The raffinate is fed, through line (39), to the washer (40). The upflow velocities and the residence times in the settling drum (37) and in column (40) are within the above-recommended ranges for drum (7) and column (12). The solvent/resin phase ratio in (40) ranges from 2 to 4. The solvent-oil mixture is recycled through line (43) before exchanger (35). The resin phase washing solvent is introduced through line (41) at the bottom of the resin phase washing column (40), after passage through exchanger (42) in order to adjust the temperature of said solvent to a value from 5° to 30° C. lower than that prevailing in settler (37).

The resin phase (44) is freed from the solvent driven along therewith in (45) by "flash" and (or) stripping. The resin phase (46) is recovered. The recovered solvent is fed, through line (47), to line (4). The process thus provides, by two stages of similar design, for the production, in a very flexible manner, of an oil phase (27) free of asphaltenes and of very low resins content as well as the simultaneous production of an asphalt phase and a resin phase, the proportions of said two last phases being adjustable at will, for a given charge, a given solvent and solvent proportions, by the selection of convenient temperatures in (7) and (37) on the one hand, in (15) and (42) on the other hand.

EXAMPLES

The following examples illustrate the invention without however limiting the scope thereof.

EXAMPLE 1

A SAFANIYA vacuum residue is deasphalted by addition of a solvent consisting essentially of a mixture of pentane and isopentane. The characteristics of the residue are given in table 1 and the composition of the $C_5$ cut in table 2.

TABLE 1

CHARACTERISTICS OF THE SAFANIYA CHARGE VACUUM RESIDUE

| | AVERAGE VALUES |
|---|---|
| Yield in % by weight of the crude oil | 33 |
| Density at 15° C. | 1.037 |
| Viscosity at 100° C. $mm^2/s$ (cSt) | 5480 |
| Viscosity at 150° C. $mm^2/s$ (cSt) | 349 |
| Penetration (1/10 mm) | 41 |
| Softening point (°C.) | 55 |
| Conradson carbon (% by weight) | 24.0 |
| C5 asphaltenes (% by weight) | 24.1 |
| C7 asphaltenes (% by weight) | 13.6 |
| Sulfur (% by weight) | 5.38 |
| Nitrogen (ppm) | 4550 |
| Nickel (ppm) | 50 |
| Vanadium (ppm) | 169 |
| Nickel + vanadium (ppm) | 219 |
| Carbon (% ppm) | 83.64 |
| Hydrogen (% by weight) | 9.94 |
| H/C atomic ratio | 1.42 |
| Saturated (% by weight) | 8.13 |
| Aromatics (% by weight) | 60.99 |
| Resins (% by weight) | 16.29 |

TABLE 2

AVERAGE CHARACTERISTICS OF THE SOLVENT (% BY WEIGHT)

| | |
|---|---|
| C1 | 0.01 |
| C2 | 0.03 |
| C3 | 0.03 |
| iC4 | 0.01 |
| nC4 | 0.04 |
| iC5 | 22.88 |
| nC5 | 76.6 |
| C5+ | 0.4 |
| Density at 15° C. | 0.631 |

The operation is conducted in a unit of a treatment capacity from 1 to 3 t/h of residue whose process characteristics are similar to those of the precedingly described invention. The tubular exchanger is placed vertically. The washing-repeptization column is equipped with horizontal baffles so crisscrossed as to obtain the equivalent of two theoretical stages for the transfer as well of the mass as of the heat. A series of 10 tests have been conducted in conformity with the flow sheet of FIG. 1. The operating conditions are those reported in table 3. In said series of tests, the solvent of the oil-solvent mixture was recovered in a proportion of 90% in a cascade of falling-film evaporators and for the remaining 10% by stripping of the oil phase, under pressures lower than those applied in the settling operation. After removal of the solvent, as well of the oil phase as of the asphalt phase, respectively in (23) and (21), as shown in FIG. 1, the oil and asphalt phases are stored and analyzed. Table 4 gives the yields and some of the characteristics of the obtained products.

This series of tests confirms the soundness of the process flow-sheet and of the recommended operating conditions. It appears that the quality of the oil is improved when the precipitation and (or) settling temperature increases and, at a given temperature, when the solvent/charge ratio increases. The four last tests show more particularly the importance of the washing step and of the operating conditions applied in said step on the oil yield on the one hand, and on the asphalt characteristics, on the other hand: the yield of deasphalted oil increases when the washing solvent flow rate increases and when the temperature at the bottom of the washing column decreases.

EXAMPLE 2

A straight-run BOSCAN residue is deasphalted by addition of the same solvent of C5 cut type as used in example 1. The operation is conducted in the same unit as described with reference to example 1. The operating conditions applied in the selected tests for illustrating the interest of the process are reported in table 6. Table 5 gives the essential characteristics of the treated charge and table 7 the yields and characterisics of the obtained products. This example has been more particularly selected to illustrate the importance of the washing step on the yields of deasphalted oil. This series of tests also makes obvious the importance of the conditions applied in the washing step. The oil yields are the higher as the washing temperature is lower and the solvent/asphalt phase ratio higher. In all the tests, the volume of asphalt phase, consisting of, the output of the settler, of asphalt swelled with solvent and oil, ranges from 1.6 to 2 times the volume of final asphalt discharged from the washing tower. This implies that the ratio of the solvent to the asphalt phase supplied to the washing tower in the preceding tests remains always in the range from 0.5 to 8.

EXAMPLE 3

SAFANIYA vacuum residue, whose characteristics are reported in table 1, is deasphalted, but with the use for the precipitation of C4 cut containing by weight 3% of propane, 35% of isobutane, 61% of butane and 1% of isopentane. The tests are conducted in the same unit as described in the preceding examples. The operating conditions of the tests series are summarized in table 8; the yields and characteristics of the obtained products are reported in table 9.

TABLE 3

| TEST | 1 | 2 | 3 | 4 | 5 | 6 | 7 | 8 | 9 | 10 |
|---|---|---|---|---|---|---|---|---|---|---|
| Charge flow rate ($m^3/h$) (1) | 2 | 2 | 2 | 2 | 2 | 2 | 2 | 2 | 2 | 2 |
| Solvent flow rate ($m^3/h$) (3 + 4) | 6 | 7 | 8 | 10 | 8 | 8 | 8 | 8 | 8 | 8 |
| Turbulence $10^5$ Re (6) | 4 | 4.5 | 5 | 6 | 5 | 5 | 5 | 5 | 5 | 5 |
| Residence time (min) (7) | 12 | 10.7 | 10 | 12 | 10 | 10 | 10 | 10 | 10 | 10 |
| Average upflow velocity (m/h) (7) | 36 | 32.1 | 29 | 24 | 29 | 29 | 29 | 29 | 29 | 29 |
| Average temperature (°C.) (7) | 180 | 180 | 180 | 180 | 190 | 165 | 180 | 180 | 180 | 180 |
| Asphalt phase flow rate ($m^3/h$) (11) | 0.9 | 0.97 | 1.01 | 1.06 | 1.1 | 0.81 | 0.85 | 0.88 | 0.85 | 0.85 |
| Solvent flow rate ($m^3/h$) (14) | 3 | 3 | 3 | 3 | 3 | 3 | 1.5 | 4 | 2 | 2 |
| Solvent temperature (S'1) (14) | 150 | 150 | 150 | 150 | 150 | 150 | 150 | 150 | 140 | 170 |
| Pressure (MPa) (7) | 4.1 | 4.1 | 4.1 | 4.1 | 4.2 | 4.0 | 4.1 | 4.1 | 4.1 | 4.1 |

TABLE 4

| TEST | 1 | 2 | 3 | 4 | 5 | 6 | 7 | 8 | 9 | 10 |
|---|---|---|---|---|---|---|---|---|---|---|
| Asphalt yield (% by weight) | 28 | 29.3 | 29.7 | 30 | 31 | 27.2 | 30.1 | 26.9 | 28.9 | 32.2 |
| Oil yield (% by weight) | 72 | 70.7 | 70.3 | 70 | 69 | 72.8 | 69.9 | 73.1 | 71.1 | 67.8 |
| Oil characteristics: | | | | | | | | | | |
| Conradson carbon (% by weight) | 14.1 | 13.7 | 13.4 | 12.2 | 11.8 | 14.9 | 13.0 | 13.5 | 13.9 | 12.5 |
| Nickel + Vanadium (ppm) | 65 | 58 | 58 | 53 | 50 | 73 | 56 | 60 | 66 | 55 |
| Sulfur (% by weight) | 4.66 | 4.58 | 4.60 | 4.50 | 4.40 | 4.77 | 4.60 | 4.66 | 4.63 | 4.41 |
| Nitrogen (ppm) | 3200 | 3060 | — | — | — | — | — | — | 3100 | — |
| C7 asphaltene (AFNOR NFT 60115) | 0.08 | <0.05 | <0.05 | <0.05 | <0.05 | <0.12 | <0.05 | <0.05 | <0.05 | <0.05 |
| Asphalt characteristics: | | | | | | | | | | |
| Softening point (°C.) | 149 | 155 | 161 | 163 | 169 | 171 | 158 | 163 | 167 | 149 |
| Conradson carbon (% by weight) | 44.2 | 43.7 | 46.3 | 51.3 | 50.6 | 48.1 | 49.2 | 52.7 | 48.6 | 48.6 |
| Nickel + Vanadium (ppm) | 510 | 540 | 562 | 591 | 620 | 609 | 595 | 639 | 607 | 550 |
| Sulfur (% by weight) | 6.86 | 7.33 | 7.27 | 7.40 | 7.62 | 6.98 | 7.18 | 7.35 | 7.30 | 7.45 |
| Nitrogen (ppm) | 8075 | 8100 | — | — | — | — | — | — | 7980 | — |

TABLE 5

| BOSCAN STRAIGHT-RUN RESIDUE CHARACTERISTICS | |
|---|---|
| Yield in % by weight of the crude oil | 83.57 |
| Density | 1.0245 |
| Viscosity at 100° C. (cSt) | 2280 |
| Viscosity at 150° C. (cSt) | 156 |
| Sulfur (% by weight) | 5.52 |
| Nitrogen (ppm) | 6800 |
| Conradson carbon (% by weight) | 18.7 |
| C5 asphaltenes (% by weight) | 23.8 |
| C7 asphaltenes (% by weight) | 16.4 |
| Nickel (ppm) | 150 |
| Vanadium (ppm) | 1200 |
| Ni + V (ppm) | 1350 |

TABLE 6

| TEST | 1 | 2 | 3 | 4 | 5 | 6 |
|---|---|---|---|---|---|---|
| Charge flow rate ($m^3/h$) | 2 | 2 | 2 | 2 | 2 | 2 |
| Total solvent flow rate (3 + 4) $m^3/h$ | 8 | 8 | 8 | 8 | 8 | 8 |
| Residence time (5 + 6) (s) | 100 | 100 | 100 | 100 | 100 | 100 |
| Residence time (7) (min) | 10 | 10 | 10 | 10 | 10 | 10 |
| Upflow velocity (7) (m/h) | 29 | 29 | 29 | 29 | 29 | 29 |
| Average temperature (7) °C. | 175 | 185 | 185 | 185 | 185 | 185 |
| Washing solvent (14) ($m^3/h$) | 2.5 | 2.5 | 2.5 | 2.5 | 1.5 | 4 |
| Asphalt phase flow rate (11) ($m^3/h$) | 0.8 | 0.92 | 0.91 | 0.87 | 0.83 | 0.84 |
| Asphalt phase temperature in (11) | 170 | 178 | 178 | 177 | 177 | 180 |
| Solvent temperature in (14) °C. | 140 | 150 | 160 | 170 | 150 | 150 |
| Pressure in (7) (M. Pascals) | 4.1 | 4.1 | 4.1 | 4.1 | 4.1 | 4.1 |

TABLE 7

| TEST | 1 | 2 | 3 | 4 | 5 | 6 |
|---|---|---|---|---|---|---|
| Asphalt yield (% by weight) | 28.5 | 30.4 | 33 | 34.9 | 31.3 | 29.2 |
| Oil yield (% by weight) | 71.5 | 69.6 | 67 | 65.1 | 68.7 | 70.8 |
| Oil characteristics: | | | | | | |
| Conradson carbon (% by weight) | 11.8 | 10.3 | 9 | 7.8 | 10.1 | 10.4 |
| Nickel + Vanadium (ppm) | 417 | 397 | 381 | 375 | 385 | 391 |
| Sulfur (% by weight) | 5.27 | 5.20 | 5.10 | 5.05 | 5.15 | 5.20 |
| C7 asphaltenes (% by weight) | 0.1 | <0.05 | <0.05 | <0.05 | <0.05 | <0.05 |
| Asphalts characteristics: | | | | | | |
| Softening point (°C.) | 167 | 160 | 152 | 148 | 147 | 163 |
| Nickel + Vanadium (ppm) | 3691 | 3532 | 3310 | 3169 | 3497 | 3674 |
| Sulfur (% by weight) | 6.14 | 6.25 | 6.36 | 6.39 | 6.33 | 6.30 |

TABLE 8

| TEST | 1 | 2 | 3 | 4 | 5 | 6 |
|---|---|---|---|---|---|---|
| Charge flow rate ($m^3/h$) | 2 | 2 | 2 | 2 | 2 | 2 |
| Total solvent flow rate (3 + 4) ($m^3/h$) | 8 | 8 | 8 | 8 | 8 | 8 |
| Residence time (5 + 6) (s) | 100 | 100 | 100 | 100 | 100 | 100 |
| Residence time (7) (min) | 10 | 10 | 10 | 10 | 10 | 10 |
| Upflow velocity (7) (m/h) | 29 | 29 | 29 | 29 | 29 | 29 |
| Average temperature in (7) (°C.) | 110 | 120 | 120 | 120 | 120 | 120 |
| Flow rate of solvent (14) ($m^3/h$) | 3 | 3 | 3 | 3 | 2.2 | 1.8 |
| Asphalt phase flow rate ($m^3/h$) | 1.52 | 1.60 | 1.7 | 1.72 | 1.65 | 1.68 |
| Temperature of solvent (14) °C. | 90 | 80 | 100 | 120 | 100 | 100 |
| Pressure in (7) (M. Pascals) | 4.1 | 4.1 | 4.2 | 4.1 | 4.0 | 4.1 |

TABLE 9

| TEST | 1 | 2 | 3 | 4 | 5 | 6 |
|---|---|---|---|---|---|---|
| Asphalt yield (% by weight) | 45.5 | 46 | 49.5 | 55 | 51 | 52.6 |
| Oil yield (% by weight) | 54.5 | 54 | 50.5 | 46 | 49 | 47.4 |
| Oil characteristics: | | | | | | |
| Conradson carbon (% by weight) | 10.0 | 8.5 | 8.3 | 8.0 | 8.6 | 8.8 |
| Nickel + Vanadium (ppm) | 30 | 24 | 22 | 21 | 27 | 28 |
| Sulfur (% by weight) | 4.14 | 4.05 | 4.03 | 4.00 | 4.08 | 4.10 |
| Asphalt characteristics: | | | | | | |
| Softening point (°C.) | 125 | 123 | 118 | 110 | 115 | 112 |
| Nickel + Vanadium (ppm) | 446 | 448 | 428 | 380 | 404 | 404 |
| Sulfur (% by weight) | 7.16 | 7.24 | 7.03 | 6.76 | 6.90 | 6.81 |

What is claimed as the invention is:

1. A process for deasphalting an asphaltene-containing hydrocarbon charge, comprising the steps of:

(a) heating to 100°-220° C. a mixture of hydrocarbon charge with a first solvent charge comprising at least one paraffinic, olefinic or cycloparaffinic hydrocarbon having 3 to 7 carbon atoms, and feeding said heated mixture to a settling zone, the volume ratio of the solvent charge to the hydrocarbon charge being from 2.5/1 to 6/1, (b) settling the mixture in a settling zone, at a temperature from 100°-220° C., to form a light phase containing deasphalted oil and solvent and a heavy asphalt phase, wherein said light phase flows upward at an upflow velocity of less than 1 cm/second, and separating the light phase from the heavy asphalt phase, (c) subjecting the heavy asphalt phase to washing, by downward flow in a substantially vertical washing zone, counter-currently with an upward flow of a second solvent charge, said second solvent charge having substantially the same composition as the first solvent charge and being introduced at a temperature from 5° to 50° C. lower than the temperature of introduction of the heavy asphalt phase in the washing zone, the solvent/asphalt phase volume ratio in said washing zone ranging from 0.5/1 to 8/1, and recovering an oil-solvent upper phase of low asphaltene content and a lower asphalt-solvent phase of high asphaltene content, (d) directly recycling the oil-solvent upper phase of step (c) to the settling zone of step (a), (e) separating the solvent from the lower phase of step (c) and recovering an asphalt phase, and (f) separating the solvent from the light phase of step (b) and recovering the deasphalted oil phase.

2. A process according to claim 1, wherein the mixture of hydrocarbons charge with the first solvent charge, introduced in the settling zone, is obtained by admixing of the two charges, subsequent heating up to 100°-220° C., then feeding of the heated mixture to the settling zone, the REYNOLDS number of the heated mixture thus fed to the settling zone being from $2\times10^4$ to $10^6$ and the time interval between the beginning of the heating to the time of introduction in the settling zone being from 5 seconds to 120 seconds.

3. A process according to claim 2, wherein in step (d) the upper phase of step (c) is mixed with the hydrocarbons charge and the first solvent charge of step (a), the resultant mixture being then heated to 100°-220° C. and fed to the settling zone with said REYNOLDS number and said time interval.

4. A process according to claim 1, wherein the heating of the mixture in step (a) is performed in a tubular, vertical exchanger and said mixture flows downwardly in said exchanger.

5. A process according to claim 1, wherein step (a) lasts from 20 to 120 seconds and the REYNOLDS number is from $5\times10^4$ to to $5\times10^5$.

6. A process according to claim 1, wherein the settling zone is of elongated shape, inclined by 5° to 10° to the horizontal, in the direction of flow of the mixture.

7. A process according to claim 1, wherein the solvent to asphalt phase volume ratio in the washing zone is from 2/1 to 4/1, said washing zone comprising an upper portion above the point of introduction of the heavy asphalt phase into said washing zone, and said upper portion having a greater cross-sectional area than said wash zone below said point of introduction of the heavy asphalt phase.

8. A process according to claim 1, wherein the solvent to hydrocarbons charge volume ratio in step (a) is from 3/1 to 4/1.

9. A process according to claim 1, wherein the residence time in each of steps (b) and (c) is from 4 to 20 minutes.

10. A process according to claim 1, wherein the hydrocarbon charge in step (a) results from the prior steps of:

(i) settling a mixture of an asphaltene containing hydrocarbon charge with at least one paraffinic, olefinic or cycloparaffinic hydrocarbon solvent having 3-7 carbon atoms, at a ratio of solvent to hydrocarbon charge of 2.5/1 to 6/1 by volume, at a temperature from 10° to 40° C. lower than the settling temperature of step (b), so as to form a light phase and a heavy asphalt phase, wherein the resultant light phase flows upward at an upflow velocity of less than 1 cm/second, (ii) washing resultant heavy asphalt phase from step (i) in downward flow, counter-currently to an upward flow of said hydrocarbon solvent of substantially the same composition as in step (i), the solvent/heavy asphalt phase ratio by volume in said step (ii) being from 0.5/1 to 8/1, and (iii) admixing said light phase of step (i) with said solvent which has been separated from said heavy asphalt phase in step (ii) to constitute said hydrocarbon charge in step (a).

11. A process according to claim 1, wherein the asphaltene-containing hydrocarbon charge is a SAFANIYA vacuum residue or BOSCAN straight-run residue.

12. A process for deasphalting an asphaltene-containing hydrocarbon charge, comprising the steps of:

(a) introducing, in a settling zone, a mixture of hydrocarbon charge with a first solvent charge comprising at least one paraffinic, olefinic or cycloparaffinic hydrocarbon having 3 to 7 carbon atoms, the volume ratio of the solvent charge to the hydrocarbon charge being from 2.5/1 to 6/1, (b) settling the mixture in a settling zone, to form a light phase containing deasphalted oil and solvent and a heavy asphalt phase, wherein said light phase flows upward at an upflow velocity of less than 1 cm/second, and separating the light phase, from the heavy asphalt phase, (c) subjecting the heavy asphalt phase to washing, by downward flow in a substantially vertical washing zone, counter-currently with an upward flow of a second solvent charge, said second solvent charge having substantially the same composition as the first solvent charge and being introduced at a temperature from 5° to 50° C. lower than the temperature of introduction of the heavy asphalt phase in the washing zone, the solvent/asphalt phase volume ratio ranging from 0.5/1 to 8/1, and recovering an oil-solvent upper phase of low asphaltene content and a lower asphalt-solvent phase of high asphaltene content, (d) directly recycling the oil-solvent upper phase of step (c) to the settling zone of step (a) without separating the oil from the solvent, (e) separating the solvent from the lower phase of step (c) and recovering an asphalt phase, and (f) separating the solvent from the light phase of step (b) and recovering the deasphalted oil phase.

* * * * *